US011015254B2

(12) United States Patent
Dang et al.

(10) Patent No.: US 11,015,254 B2
(45) Date of Patent: May 25, 2021

(54) ALUMINUM ELECTROLYTIC BATH HAVING CONTINUOUS ALUMINUM-FRAME ANODE WITH BUILT-IN CONDUCTORS

(71) Applicants: SHANXI JINGZHI ALUMINIUM TECHNOLOGY CO., LTD., Yuncheng (CN); Wenke Shi, Yuncheng (CN); Jianping Dang, Yuncheng (CN)

(72) Inventors: Jianping Dang, Yuncheng (CN); Xingpei Dang, Yuncheng (CN)

( * ) Notice: Subject to any disclaimer, the term of this patent is extended or adjusted under 35 U.S.C. 154(b) by 405 days.

(21) Appl. No.: 16/231,595

(22) Filed: Dec. 23, 2018

(65) Prior Publication Data

US 2019/0127868 A1 May 2, 2019

Related U.S. Application Data

(63) Continuation of application No. PCT/CN2017/000364, filed on May 19, 2017.

(51) Int. Cl.

| | |
|---|---|
| ***C25C 3/12*** | (2006.01) |
| ***C25C 3/08*** | (2006.01) |
| ***C25C 3/16*** | (2006.01) |
| ***C25C 3/18*** | (2006.01) |

(52) U.S. Cl.

CPC ..... *C25C 3/125* (2013.01); *C25C 3/085* (2013.01); *C25C 3/16* (2013.01); *C25C 3/18* (2013.01)

(58) Field of Classification Search

CPC ..... C25C 3/06–3/24

See application file for complete search history.

(56) References Cited

U.S. PATENT DOCUMENTS

| | | | |
|---|---|---|---|
| 2,739,113 | A | 3/1956 | Horsfield et al. |
| 5,779,875 | A | 7/1998 | Budaev et al. |
| 7,384,521 | B2 | 6/2008 | Wang et al. |

FOREIGN PATENT DOCUMENTS

| | | | |
|---|---|---|---|
| CN | 1033530 | A | 6/1989 |
| CN | 1058242 | A | 1/1992 |
| CN | 1270239 | A | 10/2000 |
| CN | 106894055 | A | 6/2008 |
| CN | 201713581 | U | 1/2011 |
| CN | 202610350 | U | 12/2012 |
| CN | 202610351 | U | 12/2012 |
| CN | 104342720 | A | 2/2015 |
| CN | 206428334 | U | 8/2017 |
| RU | 2207408 | C1 | 6/2003 |
| SU | 1014994 | A1 | 4/1983 |

OTHER PUBLICATIONS

Internation Search Report of PCT/CN2017/000364, dated Sep. 26, 2017.

*Primary Examiner* — Ciel P Contreras

(74) *Attorney, Agent, or Firm* — Erson IP (Nelson IP)

(57) ABSTRACT

An aluminum electrolytic bath having continuous aluminum-frame anode with built-in conductors, solving the problems of the existing aluminum electrolytic baths, such as poor electrical and thermal conductivity and exhausting capability, high energy consumption, complex operation, poor electrolytic bath stability, large amount of asphalt fumes and the difficulties in collecting the same and in electrolytic fume purification, few variety and poor quality of produced products, and influence on integrity of the anode, includes an aluminum-frame anode and a cathode. The disclosure greatly reduces power consumption and improves current efficiency, the stability and yield of the electrolytic bath.

10 Claims, 3 Drawing Sheets

ALUMINUM ELECTROLYTIC BATH HAVING CONTINUOUS ALUMINUM-FRAME ANODE WITH BUILT-IN CONDUCTORS

CROSS-REFERENCE TO RELATED APPLICATIONS

This application, is a continuation of International Patent Application No. PCT/CN2017/000364 with a filing date of May 19, 2017, designating the United States, and further claims priority to Chinese Patent Application No. 201611257730.5 with a filing date of Dec. 30, 2016. The content of the aforementioned applications, including any intervening amendments thereto, are incorporated herein by reference.

TECHNICAL FIELD

The disclosure relates to an aluminum electrolytic bath for producing electrolytic aluminum, high-purity aluminum, refined aluminum and aluminum alloy, and particularly relates to an aluminum electrolytic bath having continuous aluminum-frame anode with built-in conductors, which is capable of improving uniform conductive capability of the aluminum-frame anode and quickening a heat dissipation speed at a center of the aluminum-frame anode and a discharging, speed of gases in the anode, and has the advantages of extremely small amount and no escape of pitch flue gas produced in the aluminum-frame anode, simple operation, energy conservation and environment friendliness, low cost and high product additional value.

BACKGROUND OF THE PRESENT INVENTION

At present, in order to solve the defects caused by a fact that an anode of a main-stream large or super-huge prebake aluminum electrolytic bath cannot be continuously used in the process of electrolytic aluminum production, an energy-saving and environmental-friendly aluminum electrolytic bath capable of performing continuous production and achieving stable operation of the aluminum electrolytic bath under a low polar distance is disclosed.

The existing energy-saving environmental-friendly aluminum electrolytic bath gains a technical improvement in the aspects of production of electrolytic aluminum, high-purity aluminum, refined aluminum and aluminum alloy, however, the anode adopted in the existing electrolytic bath is made of anode paste. The single anode is large in volume and over large in cross section area, relatively poor in thermal conductivity and slow in heat transfer speed. Thus, excess heat inside the anode cannot be timely diffused toward the sides of the anode to form a problem that the internal temperature of the anode is high and the temperatures of four sides are low, resulting in that the single anode is high in conical inner body, low in conical peripheral body, small in center resistance, large in peripheral resistance, uneven in current distribution, raised in voltage drop and high in energy consumption. Since a current-conducting rod is inserted into the anode by a small depth and the electrical resistivity of the conical body of the anode is relative high, leading to the high voltage drop of the anode and high energy consumption. The bottom area of the anode is too large to discharge an anode gas produced at the bottom of the anode smoothly to the outside, the discharging speed is low, causing problems that the resistance of anode bubble is high, the electrolytic bath is unstable, current efficiency is low, energy consumption is high and the like. Meanwhile, it is needed to knock in the current-conducting rod and pull out the current-conducting rod at regular intervals, however, knocking-in and pulling-out operations of the current-conducting rod are complicated and large in labor intensity, pitch flue gas is large in amount and difficult in collection, cost is high, and product quality, arrangement of conductors in the anode, and even integrity of the anode, are influenced.

SUMMARY OF PRESENT INVENTION

In order to solve the problems of the existing aluminum electrolytic bath that electric conducting and heat conducting capabilities are poor, energy consumption is high, operation is complicated, stability is poor, pitch flue gas is large in amount and difficult in collection, it is difficult to purify electrolytic flue gas, produced products are few in variety and poor in quality and the integrity of the anode is influenced, an aluminum electrolytic bath having continuous aluminum-frame anode with built-in conductors is provided.

The disclosure is achieved by adopting the following technical solutions: an aluminum electrolytic bath having continuous aluminum-frame anode with built-in conductors includes an aluminum-frame anode and a cathode located under the aluminum-frame anode, the aluminum-frame anode includes an aluminum frame with a carbon material and the conductors arranged therein, and a wall thickness of the aluminum frame is 0.1-5 cm; a first holding frame and a second holding frame are arranged around the aluminum frame; a plurality of vertically placed anode guide rods are respectively arranged between the first holding frame and the aluminum frame and between the second holding frame and the aluminum frame; an anode beam bus is arranged at and connected to upper parts of the anode guide rods; a shelling, blanking and exhausting mechanism is arranged around the aluminum frame.

When electrolysis operation is performed, the aluminum-frame anode is integrally installed above the cathode through the first holding frame and the second holding frame, current enters the anode guide rod, the aluminum frame and the conductors through the anode beam bus and then conducted by a sintering body until entering the liquid electrolyte. Heat in the center of the aluminum-frame anode is mainly delivered to the sides of the aluminum-frame anode through the conductors until being delivered to the sides of the aluminum frame and the anode guide rod. Most of anode gases produced at the bottom of the sintering body pass through a seam formed after the conductors depart from the sintering body, then discharged to the outside of the aluminum frame, and finally to the outside of the electrolytic bath. With the proceeding of the production process, the sintering body on the lower part of the aluminum-frame anode is continuously consumed, the aluminum frame which is made outside the electrolytic bath and provided with the conductors needs to be placed on the upper part of the aluminum-frame anode in the electrolytic bath, a carbon material is added between the aluminum frame and the conductors, or the aluminum frame made outside the electrolytic bath is connected to the upper part of the aluminum-frame anode in the electrolytic bath, and the carbon material with the conductors is added in the aluminum frame, or the electrolytic bath is connected to the upper part of the aluminum frame anode in the electrolytic bath, the carbon material is added in the aluminum frame, and the conductors are inserted into the carbon material, or the aluminum-frame anode made outside the electrolytic bath is integrally connected to the upper part of the aluminum-frame anode in the electrolytic bath, and the carbon material in the aluminum-frame anode is sintered as the sintering body at high temperature so that the aluminum-frame anode continuously operates, thereby overcoming the problems of the existing aluminum electrolytic bath that electric conducting and heat conducting capabilities are poor, energy consumption is high, operation is complicated, stability is poor, pitch flue gas is large in amount and difficult in collection, it is difficult to purify electrolytic flue gas, produced products are few in variety and poor in quality, and the integrity of the anode is influenced.

The first holding frame and the second holding frame are both provided with a plurality of pushing bolts contacting with the aluminum frame and the anode guide rods, and gas collecting hoods are respectively arranged between an external wall of the first holding frame and the cathode and between an external wall of the second holding frame and the cathode.

With the continuous consumption of the sintering body on the lower part of the aluminum-frame anode, the first holding frame and the second holding frame hold the anode guide rods and the aluminum-frame anode to descend together with them. When a distance between the lower ends of the anode guide rods and the upper surface of the liquid electrolyte of the electrolytic bath is reduced to a certain range, the first holding frame, the second holding frame and the anode guide rods need to lift to designated positions. In the process of lifting, contacts of the first holding frame with the anode guide rods and with the aluminum frame are firstly released, the first holding frame upwardly moves to the designated position and then contact of the first holding frame with the aluminum frame is tightly locked. Subsequently, contacts of the second holding frame with the anode guide rods and with the aluminum frame is released, and all released contacts with the anode guide rods and the aluminum frame are tightly locked after the second holding frame and the anode guide rods upwardly move to the designated position, so as to achieve continuous production. The gas collecting hood achieves the purposes of sealing and preventing the flue gas of the electrolytic bath from escaping.

The conductors are made of metal, metal alloy, metal oxides, metal fluorides, metal halides, carbonate or a mixture thereof which is fusible in liquid electrolyte.

An electrolyte crust between the aluminum frame and the cathode is covered with an insulation layer, and the arrangement of the insulation layer is to reduce the heat diffusion loss of the electrolytic bath, a number of the electrolyte crust and relevant processing costs.

A number of the aluminum frames is greater than or equal to 2.

An upper end of the aluminum frame is provided with a pitch flue gas sealing and collecting cover for preventing any pitch flue gas in the aluminum-frame anode from outwardly escaping.

The first holding frame and the second holding frame are both provided with a plurality of gas collecting holes and exhausting holes, and the exhausting holes are connected with a flue gas exhausting manifold of the electrolytic bath to achieve the purpose of collecting the flue gas of the electrolytic bath.

Based on a material adding requirement, the shelling, blanking and exhausting mechanism arranged around the aluminum frame opens the crust on the liquid electrolyte to add aluminum oxide and fluoride salt into the liquid electrolyte, and flue gas produced at this place is captured to the flue gas exhausting manifold of the electrolytic bath.

The disclosure is reasonable and reliable in structure design, thereby facilitating uniform distribution of anode current and anode heat in the aluminum-frame anode, greatly reducing the voltage drop of the anode, decreasing the consumption of the electrical energy, and reducing the temperature at the center of the aluminum-frame anode, facilitating improvement of current efficiency and increasing yield. Meanwhile, an anode gas can accessibly and rapidly pass through the seam in the sintering body to be discharged from the side of the aluminum-frame anode, thereby reducing bubble voltage drop and improving the stability and efficiency of the electrolytic bath. The disclosure has the advantages that structure is simple and convenient to operate, the integrity of the aluminum-frame anode is high, the pitch flue gas produced in the aluminum-frame anode is few in amount and is not escaped, the electrolytic bath is good in sealing property and it is easy to collect flue gas, the pitch flue gas in the electrolytic bath flue gas is few in content and easy to be purified, the effect of the conductor is lasting and stable, the knocking-in and pulling-out operation of the current-conducting rod is omitted, the flue gas in the electrolytic bath is few in amount and low in purification cost, production process is safe and environmental friendly, production cost is low, produced products are various in type and stable in quality, the additional value of the product is high, the volume of the electrolytic bath is large and is not limited, and the holding frame fastens the aluminum-frame anode and the anode guide rod, with simplicity and a good effect.

Figure 1:
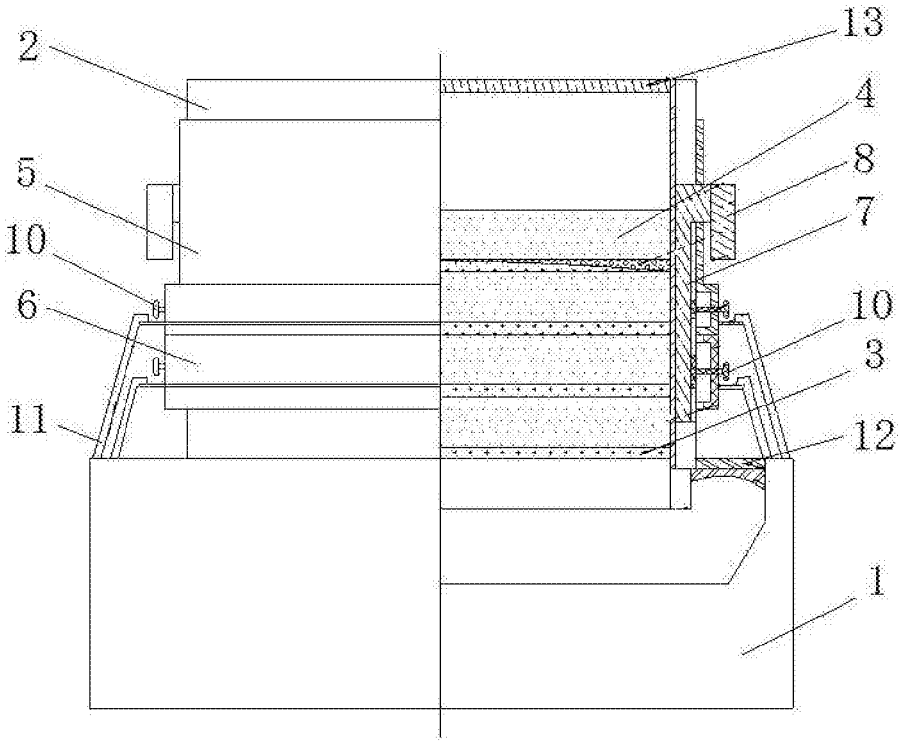
FIG. 1 is a schematic structural diagram of an aluminum electrolytic bath according to the present disclosure.
Figure 2:
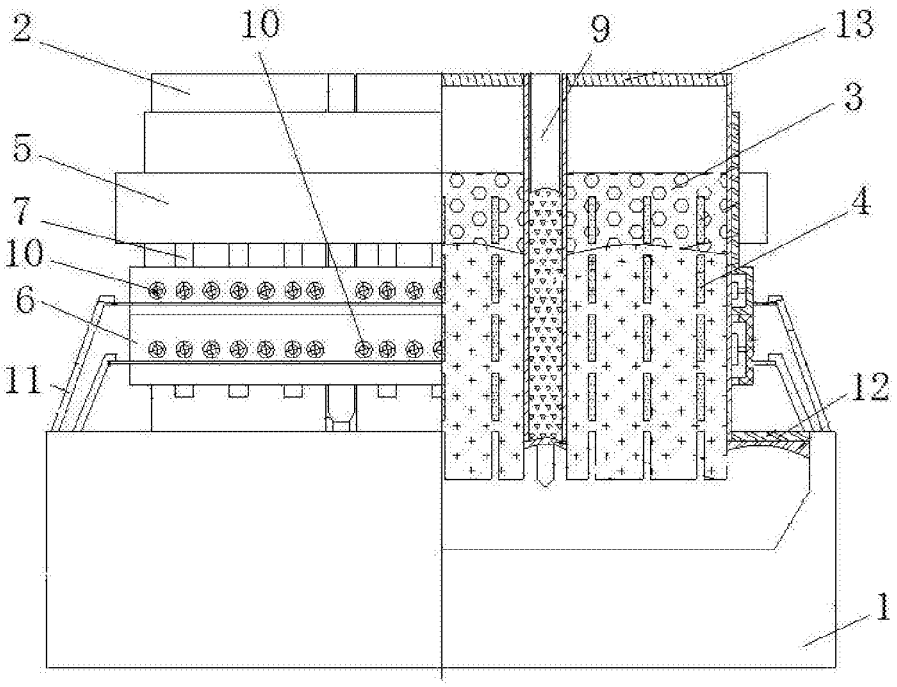
FIG. 2 is a side view of FIG. 1.
Figure 3:
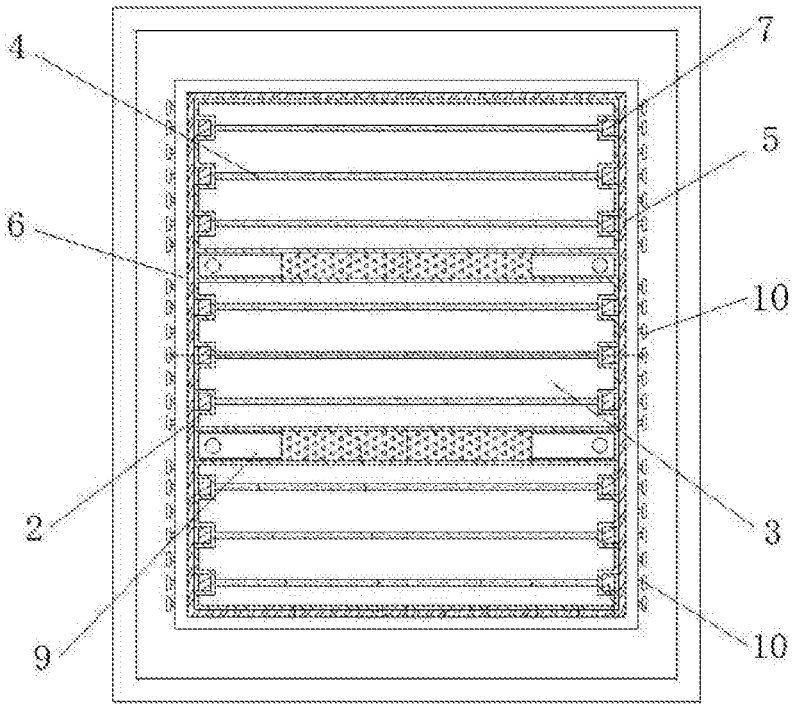
FIG. 3 is a top view of FIG. 1.

In the drawings, 1—cathode, 2—aluminum frame, 3—carbon material, 4—conductor, 5—first holding frame, 6—second holding frame, 7—anode guide rod, 8—anode beam bus, 9—shelling, blanking and exhausting mechanism, 10—pushing bolt, 11—gas collecting hood, 12—crust, and 13—pitch flue gas sealing and collecting cover.

DETAILED DESCRIPTION OF PREFERRED EMBODIMENTS

An aluminum electrolytic bath having continuous aluminum-frame anode with built-in conductors includes an aluminum-frame anode and a cathode 1 located under the aluminum-frame anode. The aluminum-frame anode includes an aluminum frame 2 with a carbon material 3 and the conductors 4 arranged in the aluminum frame 2, and a wall thickness of the aluminum frame is 0.1-5 cm. A first holding frame 5 and a second holding frame 6 are arranged around the aluminum frame 2, and a plurality of vertically placed anode guide rods 7 are respectively arranged between the first holding frame 5 and the aluminum frame 2 and between the second holding frame 6 and the aluminum frame 2. An anode beam bus 8 is arranged at and connected to upper parts of the anode guide rods 7. A shelling, blanking and exhausting mechanism 9 is arranged around the aluminum frame 2.

The first holding frame 5 and the second holding frame 6 are both provided with a plurality of pushing bolts 10 contacting with the aluminum frame 2 and the anode guide rod 7, and gas collecting hoods 11 are respectively arranged between the external wall of the first holding frame 5 and the cathode 1 and between the external wall of the second holding frame 6 and the cathode 1. The conductors 4 are made of metal, metal alloy, metal oxides, metal fluorides, metal halides, carbonate or a mixture thereof which is fusible in liquid electrolyte. The electrolyte crust between the aluminum frame 2 and the cathode 1 is covered with an insulation layer 12. A number of the aluminum frame 2 is greater than or equal to 2. An upper end of the aluminum frame 2 is provided with a pitch flue gas sealing and collecting cover 13. Both of the first holding frame 5 and the second holding frame 6 are provided with a plurality of gas collecting holes and exhausting holes.

In a specific implementation process, the number, size, shape and structure of the aluminum-frame anode and an arrangement of the aluminum-frame anode in the electrolytic bath are set according to the volume of the electrolytic bath, uniform distribution requirement of aluminum oxide concentration, firmness and convenience in fastening the aluminum-frame anode by the first holding frame 5 and the second holding frame 6 and contact compactness of the anode guide rods 7 and the aluminum-frame anode under the condition that the electric-conducting, heat-conducting and exhausting capabilities of the aluminum-frame anode are ensured. Meanwhile, according to requirements on electric conduction, heat conduction, exhausting and integrity of the aluminum-frame anode, on the premise that the quality of the product is ensured, an arrangement and positions of the conductors 4 in the aluminum-frame anode are set, and the number, sizes, shapes and corresponding materials of the conductors 4 arranged in the aluminum-frame anode are determined. The carbon material 3 is made of anode paste, dry anode paste, a prebaked anode carbon block, a crude anode carbon block, a binder, anode scrap, petroleum coke, pitch coke, graphite, anthracite, pitch or a mixture thereof. According to requirements that the aluminum frame 2 is integral, intact and capable of continuously sealing the carbon material 3 and the shape is continuously stable, the layer number and wall thickness of the aluminum frame 2 are set. At least one layer of aluminum frame 2 is set, which is made of virgin aluminum, refined aluminum, high-purity aluminum or aluminum alloy having more than 80% of aluminum. According to requirements that upper and lower aluminum frames 2 are convenient to connect and good in seal, facilitate the tight contact between the anode guide rods 7 and the aluminum frame 2 and meet the aluminum-frame anode, the shapes, structures, sizes and quantity of the aluminum frame 2 are set, and a successive sequence of arrangement of the conductor 4 in the aluminum frame 2 and addition of the carbon material 3 and a combination mode of three of them are set. According to requirements of fastening, bearing and operation convenience of the first holding frame 5 and the second holding frame 6 as well as the pushing bolts 10 on the anode guide rods 7 and the aluminum-frame anode, and the number of the aluminum frame 2, materials of the holding frame 5 and the second holding frame 6 as well as the pushing bolts 10 are selected, the sizes, shapes, structures, holding and fastening modes and quantity of the first holding frame 5 and the second holding frame 6 as well as the pushing bolts 10 are set, and the number of the aluminum frame 2 arranged in the single first holding frame 5 and the single second holding frame 6 is determined. According to specific discharging positions and amount of the flue gas in the electrolytic bath, the positions, sizes, quantity, structures and exhausting amount of the gas collecting holes and the exhausting holes on the first holding frame 5 and the second holding frame 6 are set. According to requirements on seal, absorption and collection of pitch flue gas, the sizes, quantity, shapes, structures of the pitch flue gas sealing and collecting cover 13 and a contact mode of the pitch flue gas sealing and collecting cover 13 with the aluminum-frame anode are set. According to a requirement that the current of the anode beam bus 8 is conducted to the aluminum-frame anode, the materials, sizes, shapes, quantity, structures of the anode guide rods 7 and a connection mode of the anode guide rods with the anode beam bus 8 are set. According to demand on insulation of the electrolytic bath and reduction of the number of the electrolyte crust, the material of the insulation layer 12 is selected, and the thickness, number, shape and structure of the insulation layer are set. According to the volume of the electrolytic bath, quantity and size of the aluminum-frame anode and the boiling state of the electrolyte, the installation position, quantity and structure of the shelling, blanking and exhausting mechanism 9 around the aluminum frame 2 are determined, and a shelling air cylinder, a hammer rod, a hammer head and a blanker are installed in the shelling, blanking and exhausting mechanism. According to the production plan of the product, the variety of the raw material used by the electrolytic bath is determined, and raw materials which can be used by this electrolytic bath are as follows: fluorine-supported aluminum oxide, fresh aluminum oxide, other metal oxides, fluorides, halides, carbonates or a mixture thereof. If the fluorine-supported aluminum oxide is used as the raw material, the electrolytic aluminum having more than 99.70% of aluminum is produced from the electrolytic bath. If the fresh aluminum oxide is used as the raw material, the high-purity aluminum or refined aluminum having more than 99.91% of aluminum is produced from the electrolytic bath. If the aluminum oxide and other metal oxides, fluorides, halides or carbonates are used as the raw materials, or other metals, metal alloy, metal oxides, or fluorides or halides or carbonates are used as conductors, aluminum alloy is directly produced from the electrolytic bath. When the number of the aluminum frame is greater than or equal to 2, the first holding frame 5 and the second holding frame 6 correspond to the aluminum frame 2 in quantity, and are arranged around each aluminum frame 2, or the number of the aluminum frame 2 is greater than or equal to 2 (however, optimal quantity is no more than 15) in the single first holding frame 5 and the single second holding frame 6, and a plurality of vertically placed anode guide rods 7 are installed around the aluminum frame 2.

We claim:

1. An aluminum electrolytic bath having a continuous aluminum-frame anode with built-in conductors, comprising the aluminum-frame anode and a cathode (1) located under the aluminum-frame anode, wherein the aluminum-frame anode includes an aluminum frame (2) with a carbon material (3) and the conductors (4) arranged therein; a first holding frame (5) and a second holding frame (6) are arranged around the aluminum frame (2); a plurality of vertically placed anode guide rods (7) are respectively arranged between the first holding frame (5) and the aluminum frame (2) and between the second holding frame (6) and the aluminum frame (2); an anode beam bus (8) is arranged at and connected to upper parts of the anode guide rods (7); a shelling, blanking and exhausting mechanism (9) is arranged around the aluminum frame (2).

2. The aluminum electrolytic bath according to claim 1, wherein, the first holding frame (5) and the second holding frame (6) are both provided with a plurality of pushing bolts (10) contacting with the aluminum frame (2) and the anode guide rods (7), and gas collecting hoods (11) are respectively arranged between an external wall of the first holding frame (5) and the cathode (1) and between an external wall of the second holding frame (6) and the cathode (1).

3. The aluminum electrolytic bath according to claim 1, wherein, the conductors (4) are made of metal, metal alloy, metal oxides, metal fluorides, metal halides, carbonate or a mixture thereof which is fusible in liquid electrolyte.

4. The aluminum electrolytic bath according to claim 1, wherein, an electrolyte crust between the aluminum frame (2) and the cathode (1) is covered with an insulation layer (12).

5. The aluminum electrolytic bath according to claim 3, wherein, an electrolyte crust between the aluminum frame (2) and the cathode (1) is covered with an insulation layer (12).

6. The aluminum electrolytic bath according to claim 1, wherein, a number of the aluminum frame (2) is greater than or equal to 2.

7. The aluminum electrolytic bath according to claim 5, wherein, a number of the aluminum frame (2) is greater than or equal to 2.

8. The aluminum electrolytic bath according to claim 1, wherein, an upper end of the aluminum frame (2) is provided with a pitch flue gas sealing and collecting cover (13).

9. The aluminum electrolytic bath according to claim 7, wherein, an upper end of the aluminum frame is provided with a pitch flue gas sealing and collecting cover (13).

10. The aluminum electrolytic bath according to claim 9, wherein, both of the first holding frame (5) and the second holding frame (6) are provided with a plurality of gas collecting holes and exhausting holes.

* * * * *